US010494229B2

(12) United States Patent
Hsu et al.

(10) Patent No.: US 10,494,229 B2
(45) Date of Patent: Dec. 3, 2019

(54) SYSTEM AND METHOD FOR RESILIENT DESIGN AND OPERATION OF ELEVATOR SYSTEM

(71) Applicant: Otis Elevator Company, Farmington, CT (US)

(72) Inventors: Arthur Hsu, South Glastonbury, CT (US); David Ginsberg, Granby, CT (US); Jose Miguel Pasini, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/419,641

(22) Filed: Jan. 30, 2017

(65) Prior Publication Data

US 2018/0215581 A1 Aug. 2, 2018

(51) Int. Cl.

| | |
|---|---|
| ***B66B 5/00*** | (2006.01) |
| ***B66B 11/04*** | (2006.01) |
| ***B66B 1/24*** | (2006.01) |
| ***B66B 9/00*** | (2006.01) |
| ***B66B 5/02*** | (2006.01) |

(52) U.S. Cl.

CPC ..... *B66B 11/0407* (2013.01); *B66B 1/2466* (2013.01); *B66B 1/2491* (2013.01); *B66B 5/0031* (2013.01); *B66B 5/024* (2013.01); *B66B 9/003* (2013.01)

(58) Field of Classification Search

CPC . B66B 11/0407; B66B 1/2466; B66B 1/2491; B66B 5/00; B66B 5/02; B66B 5/021; B66B 5/022; B66B 5/024; B66B 5/027

USPC ..... 187/247

See application file for complete search history.

(56) References Cited

U.S. PATENT DOCUMENTS

| | | | | | |
|---|---|---|---|---|---|
| 4,555,689 | A | * | 11/1985 | Brick | B66B 5/0006 187/393 |
| 4,785,914 | A | * | 11/1988 | Blain | B66B 1/24 187/280 |
| 5,392,879 | A | * | 2/1995 | Boyce | G06F 11/221 187/316 |
| 5,655,625 | A | * | 8/1997 | Barker | B66B 5/024 187/239 |

(Continued)

FOREIGN PATENT DOCUMENTS

| | | |
|---|---|---|
| CA | 2936819 A1 | 8/2015 |
| EP | 2003081 B1 | 1/2012 |

(Continued)

OTHER PUBLICATIONS

Extended European Search Report for Application No. 18154290.3 1017; dated Nov. 22, 2018; Report Received Date: Nov. 29, 2018; 9 pages.

*Primary Examiner* — David S Warren

(74) *Attorney, Agent, or Firm* — Cantor Colburn LLP

(57) ABSTRACT

According to one embodiment, a method of operating an elevator system having at least one lane is provided. The method comprising: detecting a failure in the elevator system; detecting a location of the failure within the elevator system; determining a traffic pattern of the elevator car in response to the location of the failure, the traffic pattern operable to direct the elevator car to avoid the location of the failure; and moving the elevator car in accordance with the traffic pattern selected.

5 Claims, 7 Drawing Sheets

(56) References Cited

U.S. PATENT DOCUMENTS 5,861,586 A 1/1999 McCarthy
5,877,462 A * 3/1999 Chenais ..... B66B 5/0031 187/249
5,945,644 A * 8/1999 Jang ..... B66B 5/02 187/293
6,955,245 B2 10/2005 Duenser et al.
7,537,089 B2 5/2009 Duenser et al.
7,621,376 B2 11/2009 Duenser
7,669,695 B2 * 3/2010 Hikita ..... B66B 5/024 187/284
7,721,852 B2 * 5/2010 Ishioka ..... B66B 7/08 187/313
8,020,668 B2 9/2011 Hsu et al.
9,096,410 B2 * 8/2015 Iwata ..... B66B 5/024
9,248,994 B2 2/2016 Grundmann
9,463,957 B2 10/2016 Kim et al.
2006/0016640 A1 * 1/2006 Duenser ..... B66B 1/2466 187/249
2006/0163008 A1 7/2006 Godwin
2007/0089938 A1 * 4/2007 Ishioka ..... B66B 5/18 187/391
2007/0181374 A1 8/2007 Mueller
2007/0278044 A1 * 12/2007 Hikita ..... B66B 5/024 187/247
2008/0202861 A1 * 8/2008 Kawai ..... B66B 5/024 187/384
2012/0279804 A1 * 11/2012 Iwata ..... B66B 5/0031 187/247
2013/0168191 A1 * 7/2013 Mason ..... B66B 5/0012 187/392
2014/0291074 A1 * 10/2014 Bjorni ..... B66B 9/00 187/249
2016/0046464 A1 * 2/2016 Piech ..... B66B 9/003 187/249
2016/0052748 A1 * 2/2016 Siikonen ..... B66B 5/027 187/314
2016/0075533 A1 3/2016 Scomparin
2016/0122156 A1 * 5/2016 Kondo ..... B66B 5/0031 187/247
2018/0022573 A1 * 1/2018 Hsu ..... B66B 1/2466 187/247
2018/0022574 A1 * 1/2018 Pasini ..... B66B 11/0407 187/247
2018/0105396 A1 * 4/2018 Purosto ..... B66B 7/044
2018/0162691 A1 * 6/2018 Herkel ..... B66B 13/22
2018/0215581 A1 * 8/2018 Hsu ..... B66B 5/0031
2018/0248955 A1 * 8/2018 Kinnari ..... B66B 5/025
2018/0273342 A1 * 9/2018 Hanninen ..... B66B 11/0005
2019/0023530 A1 * 1/2019 Hanninen ..... B66B 5/021

FOREIGN PATENT DOCUMENTS

JP 2013103816 A 5/2013
WO 2015178682 A1 11/2015
WO 2016083114 A1 6/2016
WO 2016109511 A1 7/2016
WO 2016126627 A1 8/2016

* cited by examiner

SYSTEM AND METHOD FOR RESILIENT DESIGN AND OPERATION OF ELEVATOR SYSTEM

BACKGROUND

The subject matter disclosed herein generally relates to the field of elevators, and more particularly to an apparatus and method operating an elevator car.

Since a multicar ropeless (MCRL) elevator system usually has fewer hoistways than a conventional system, it may be more vulnerable to failures. In one example, in a conventional system with an 8-car group and each car in a separate hoistway, when one elevator car is disabled, the group has lost ⅛ of its capacity. In another example, if a car is disabled in an MCRL lane in a 4-lane (2-loop) group, the group has lost at least ¼ of its capacity. In a third example, if a transfer station fails in a 4-lane (2-loop) group, then potentially ½ of the capacity is lost.

BRIEF SUMMARY

According to one embodiment, a method of operating an elevator system having at least one lane is provided. The method comprising: detecting a failure in the elevator system; detecting a location of the failure within the elevator system; determining a traffic pattern of the elevator car in response to the location of the failure, the traffic pattern operable to direct the elevator car to avoid the location of the failure; and moving the elevator car in accordance with the traffic pattern selected.

In addition to one or more of the features described above, or as an alternative, further embodiments may include: directing the elevator car to use a second transfer station when the failure has occurred in a first transfer station.

In addition to one or more of the features described above, or as an alternative, further embodiments may include directing the elevator car to a second lane when the failure has occurred in a first lane.

In addition to one or more of the features described above, or as an alternative, further embodiments may include directing the elevator car in a first lane to reverse direction of travel when the failure has occurred in the direction of travel in the first lane.

In addition to one or more of the features described above, or as an alternative, further embodiments may include directing the elevator car to transfer from a first lane to a third lane, when the failure has occurred in a second lane.

According to another embodiment, a method of operating an elevator system having at least three lanes is provided. The method comprising: directing elevator cars upward in at least one of a first lane and a second lane; directing elevator cars downward in a third lane; directing elevator cars to transfer at a lower transfer station from the third lane to at least one of the first lane and the second lane; directing elevator cars to transfer at an upper transfer station to the third lane from at least one of the first lane and the second lane; detecting a usage change occurring in the elevator system; and adjusting the direction of the elevator cars in each lane in response to the usage change.

In addition to one or more of the features described above, or as an alternative, further embodiments may include: assigning new upward calls to elevator cars in the first lane and new downward calls to elevator cars in the third lane; directing elevator cars downward in the third lane; directing elevator cars to transfer at the lower transfer station from the third lane to the first lane; directing elevator cars upward in the first lane; and directing elevator cars to transfer at the upper transfer station to the third lane from at least one of the first lane and the second lane.

In addition to one or more of the features described above, or as an alternative, further embodiments may include: detecting that there are no upward calls or downward calls to any elevator car in the second lane; assigning new upward calls to elevator cars in the first lane and new downward calls to elevator cars in the second lane; directing elevator cars downward in the second lane; directing elevator cars to transfer at the lower transfer station to the first lane from at least one of the second lane and third lane; directing elevator cars upward in the first lane; and directing elevator cars to transfer at the upper transfer station from the first lane to the second lane.

In addition to one or more of the features described above, or as an alternative, further embodiments may include: detecting that there are no upward calls or downward calls to any elevator car in the third lane; assigning new upward calls to elevator cars in the third lane and new downward calls to elevator cars in the second lane; directing elevator cars downward in the second lane; directing elevator cars to transfer at the lower transfer station from the second lane to the third lane; directing elevator cars upward in the third lane; and directing elevator cars to transfer at the upper transfer station to the second lane from at least one of the first lane and the third lane.

In addition to one or more of the features described above, or as an alternative, further embodiments may include: detecting that there are no upward calls or downward calls to any elevator car in the first lane; assigning new upward calls to elevator cars in the third lane and new downward calls to elevator cars in at least one of the first lane and the second lane; directing elevator cars upward in the third lane; directing elevator cars to transfer at the upper transfer station from the third lane to at least one of the first and the second lanes; directing elevator cars downward in at least one of the first lane and the second lane; and directing elevator cars to transfer at the lower transfer station to the third lane from at least one of the first lane and the second lane.

In addition to one or more of the features described above, or as an alternative, further embodiments may include: directing elevator cars downward in at least one of a first lane and a second lane; directing elevator cars upward in a third lane; directing elevator cars to transfer at an upper transfer station from the third lane to at least one of the first and the second lanes; directing elevator cars to transfer at a lower transfer station to the third lane from at least one of the first lane and the second lane; detecting a usage change occurring in the elevator system; and adjusting the direction of the elevator cars in each lane through a series of steps in response to the usage change.

In addition to one or more of the features described above, or as an alternative, further embodiments may include: assigning new upward calls to elevator cars in the third lane and new downward calls to elevator cars in the second lane; directing elevator cars downward in the second lane; directing elevator cars to transfer at the lower transfer station to the third lane from at least one of the first lane and the second lane; directing elevator cars upward in the third lane; and directing elevator cars to transfer at the upper transfer station from the third lane to the second lane.

In addition to one or more of the features described above, or as an alternative, further embodiments may include: detecting that there are no upward calls or downward calls to any elevator car in the first lane; assigning new upward calls to elevator cars in the first lane and new downward calls to elevator cars in the second lane; directing elevator cars downward in the second lane; directing elevator cars to transfer at the lower transfer station to the first lane from at least one of the second lane and third lane; directing elevator cars upward in the first lane; and directing elevator cars to transfer at the upper transfer station from the first lane to the second lane.

In addition to one or more of the features described above, or as an alternative, further embodiments may include: detecting that there are no upward calls or downward calls to any elevator car in the third lane; assigning new upward calls to elevator cars in the first lane and new downward calls to elevator cars in the third lane; directing elevator cars downward in the third lane; directing elevator cars to transfer at the lower transfer station to the first lane from at least one of the third lane and the second lane; directing elevator cars upward in the first lane; and directing elevator cars to transfer at the upper transfer station from the first lane to the third lane.

In addition to one or more of the features described above, or as an alternative, further embodiments may include: detecting that there are no upward calls or downward calls to any elevator car in the second lane; assigning new downward calls to elevator cars in the third lane and new upward calls to elevator cars in at least one of the first lane and the second lane; directing elevator cars downward in the third lane; directing elevator cars to transfer at the lower transfer station from the third lane to at least one of the first and the second lanes; directing elevator cars upward in at least one of the first lane and the second lane; and directing elevator cars to transfer at the upper transfer station to the third lane from at least one of the first lane and the second lane.

Technical effects of embodiments of the present disclosure include adjusting the traffic patterns of elevators in a multiple lane elevator system in response to at least one of an accident and a usage change.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

DETAILED DESCRIPTION

A detailed description of one or more embodiments of the disclosed apparatus and method are presented herein by way of exemplification and not limitation with reference to the Figures.

Figure 1:
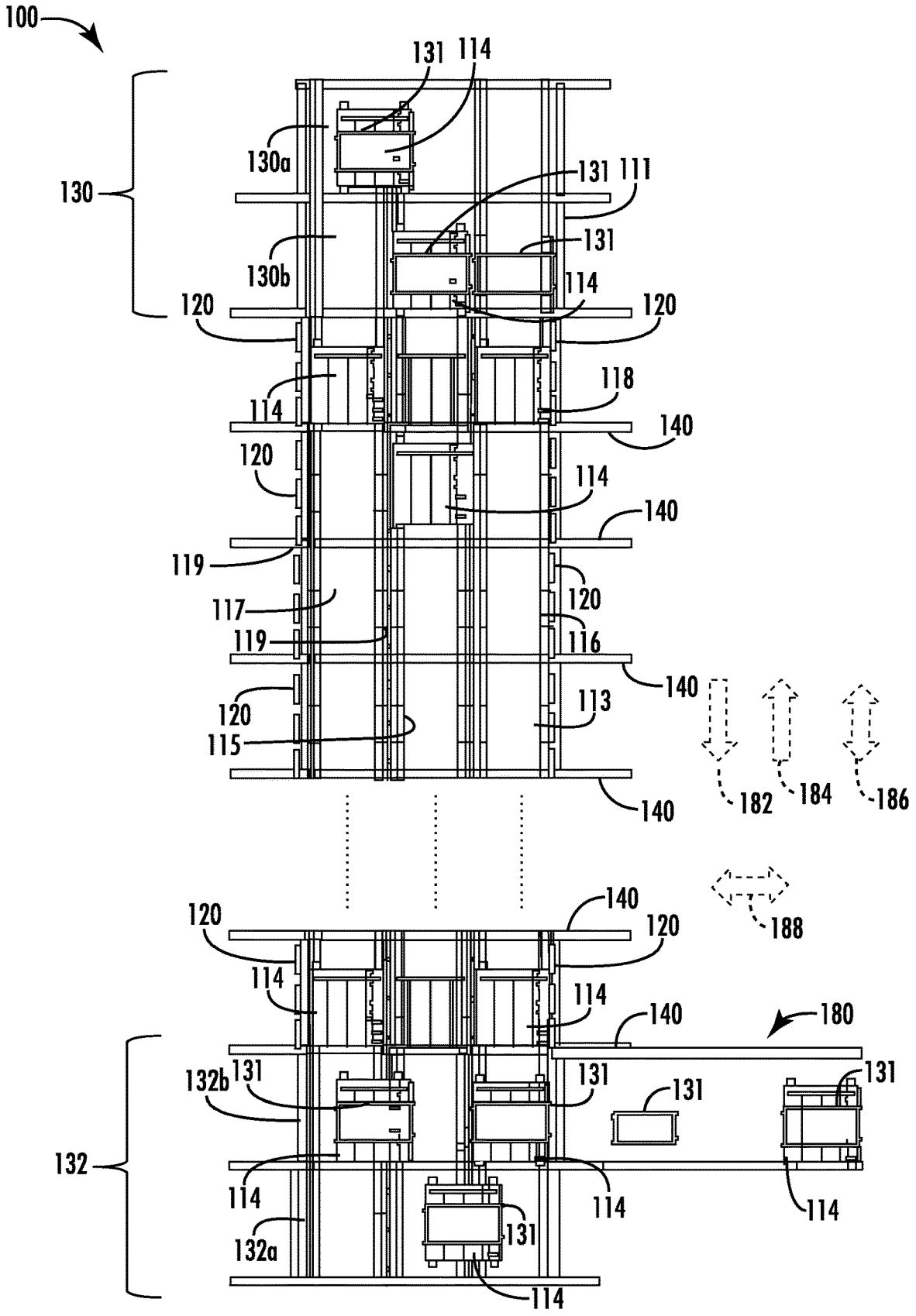
FIG. 1 illustrates a schematic view of a multicar elevator system, in accordance with an embodiment of the disclosure.

FIG. 1 depicts a multicar, ropeless elevator system 100 that may be employed with embodiments of the present disclosure. As will be appreciated by those of skill in the art, FIG. 1 depicts one multicar, ropeless elevator system 100, however the embodiments disclosed herein may be incorporated with other multicar, ropeless elevator systems or that include any other known elevator configuration. In addition, an elevator car 114 of the elevator system 100 may include two or more compartments (ex: double deck elevator). As seen in FIG. 1, the elevator system 100 includes an elevator shaft 111 having a plurality of lanes 113, 115 and 117. While three lanes 113, 115, 117 are shown in FIG. 1, it is understood that various embodiments of the present disclosure and various configurations of a multicar, ropeless elevator system may include any number of lanes, either more or fewer than the three lanes shown in FIG. 1. In each lane 113, 115, 117, multiple elevator cars 114 can travel in one direction, i.e., up as shown by arrow 184 or down as shown by arrow 182, or multiple cars within a single lane may be configured to move in opposite directions, as shown by arrow 186. For example, in FIG. 1 elevator cars 114 in lanes 113 and 115 travel up in the direction of arrow 184 and elevator cars 114 in lane 117 travel down in the direction of arrow 182. Further, as shown in FIG. 1, one or more elevator cars 114 may travel in a single lane 113, 115, and 117.

As shown, above the top accessible floor of the building is an upper transfer station 130 configured to impart lateral motion in the direction of arrow 188 to the elevator cars 114 to move the elevator cars 114 between lanes 113, 115, and 117. The lateral motion may be imparted upon the elevator car 114 using a carriage 131 configured to grab the elevator car 114 and move it through the upper transfer station 130. The upper transfer station 130 may be composed of two upper transfer stations including a first upper transfer station 130*a* and a second upper transfer station 130*b*. Advantageously, having two upper transfer stations 130*a*, 130*b* is beneficial if an elevator car 114 were to stop in one transfer station and thus block that transfer station. There may be only one upper transfer station 130*a*, 130*b* or more than two upper transfer stations 130*a*, 130*b* however only two are shown for ease of illustration. It is understood that upper transfer stations 130*a*, 130*b* may be located at the top two floors, rather than the two upper transfer stations being above the top floor, or in any other similar arrangement. Similarly, below the first floor of the building is a lower transfer station 132 configured to impart lateral motion to the elevator cars 114 to move the elevator cars 114 between lanes 113, 115, and 117. The lateral motion may be imparted upon the elevator car 114 using a carriage 131 configured to grab the elevator car 114 and move it through the lower transfer station 132. The lower transfer station 132 may be composed of two lower transfer stations including a first lower transfer station 132*a* and a second upper transfer station 132*b*. Advantageously, having two lower transfer stations 132*a*, 132*b* is beneficial if an elevator car 114 were to stop in one transfer station and thus block that transfer station. There may be only one lower transfer station 132, 132*b*, or more than two lower transfer stations 132*a*, 132*b* however only two are shown for ease of illustration. It is understood that lower transfer stations 132*a*, 132*b* may be located at the two bottom floors, rather than both lower transfer stations 132*a*, 132*b* being below the bottom floor, or in any other similar arrangement. Although not shown in FIG. 1, one or more intermediate transfer stations may be configured between the lower transfer station 132 and the upper transfer station 130. Intermediate transfer stations are similar to the upper transfer station 130 and lower transfer station 132 and are configured to impart lateral motion to the elevator cars 114 at the respective transfer station, thus enabling transfer from one lane to another lane at an intermediary point within the elevator shaft 111. Further, although not shown in FIG. 1, the elevator cars 114 are configured to stop at a plurality of floors 140 to allow ingress to and egress from the elevator cars 114. In the illustrated embodiment the elevator system 100 includes a designated parking area 180. The designated parking area 180 may be used to store elevator cars 114 and/or carriages 131 when not in use.

Elevator cars 114 are propelled within lanes 113, 115, 117 using a propulsion system such as a linear, permanent magnet motor system having a first, fixed portion, or first part 116, and a secondary, moving portion, or second part 118. The first part 116 is a fixed part because it is mounted to a portion of the lane, and the second part 118 is a moving part because it is mounted on the elevator car 114 that is movable within the lane. The first part 116 includes windings or coils mounted on a structural member 119, and may be mounted at one or both sides of the lanes 113, 115, and 117, relative to the elevator cars 114.

The second part 118 includes permanent magnets mounted to one or both sides of cars 114, i.e., on the same sides as the first part 116. The second part 118 engages with the first part 116 to support and drive the elevators cars 114 within the lanes 113, 115, 117. First part 116 is supplied with drive signals from one or more drive units 120 to control movement of elevator cars 114 in their respective lanes through the linear, permanent magnet motor system. The second part 118 operably connects with and electromagnetically operates with the first part 116 to be driven by the signals and electrical power. The driven second part 118 enables the elevator cars 114 to move along the first part 116 and thus move within a lane 113, 115, and 117.

Those of skill in the art will appreciate that the first part 116 and second part 118 are not limited to this example. In alternative embodiments, the first part 116 may be configured as permanent magnets, and the second part 118 may be configured as windings or coils. Further, those of skill in the art will appreciate that other types of propulsion may be used without departing from the scope of the present disclosure.

The first part 116 is formed from a plurality of motor segments 122 (seen in FIG. 2), with each segment associated with a drive unit 120. Although not shown, the central lane 115 of FIG. 1 also includes a drive unit for each segment of the first part 116 that is within the lane 115. Those of skill in the art will appreciate that although a drive unit 120 is provided for each motor segment 122 (seen in FIG. 2) of the system (one-to-one) other configurations may be used without departing from the scope of the present disclosure. Further, those of skill in the art will appreciate that other types of propulsion may be employed without departing from the scope of the present disclosure. For example, a magnetic screw may be used for a propulsion system of elevator cars. Those of skill in the art will also appreciate that the embodiments disclosed herein may also be applied to roped elevator systems and hydraulically operated elevator systems. Thus, the described and shown propulsion system of this disclosure is merely provided for explanatory purposes, and is not intended to be limiting.

Figure 2:
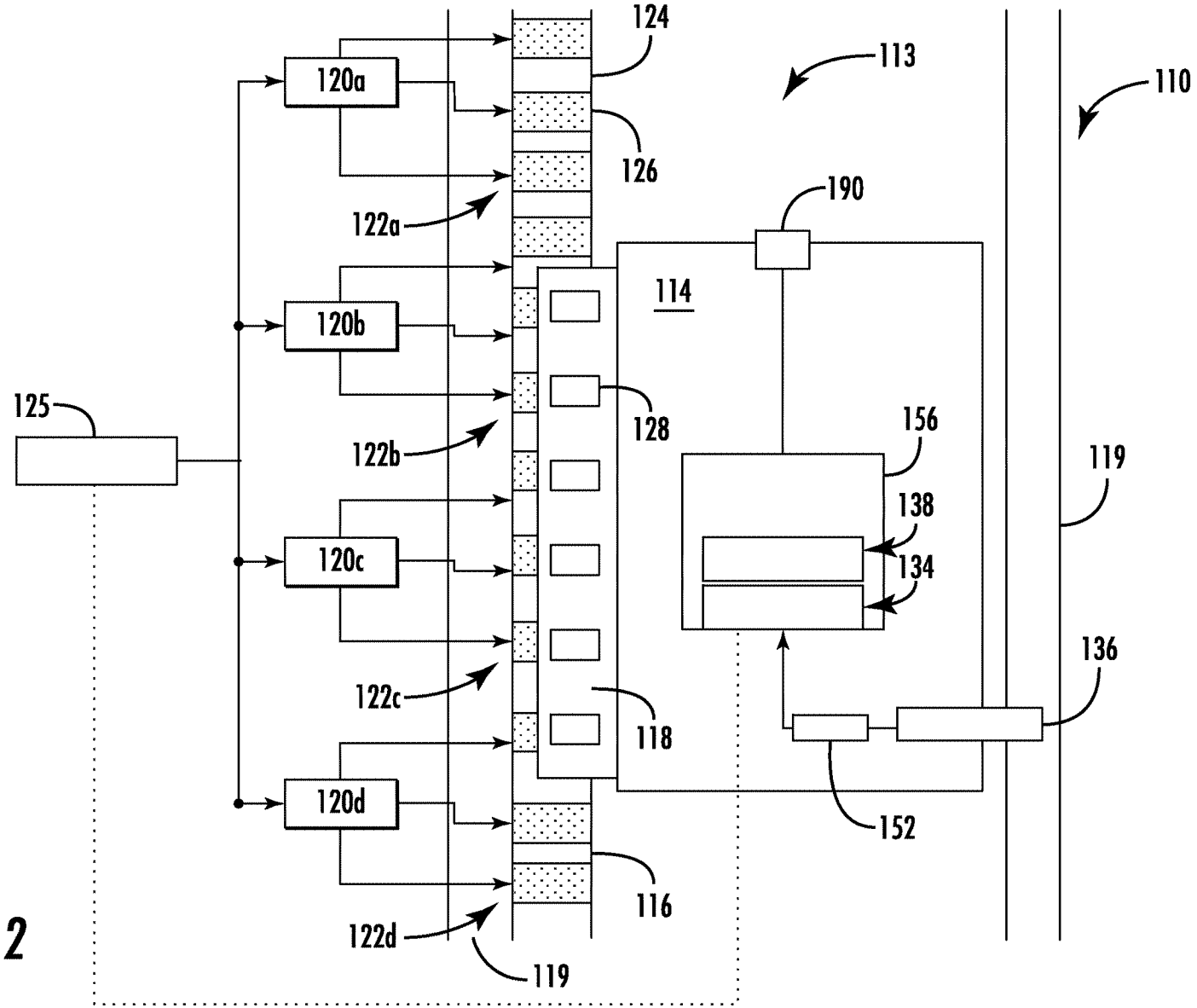
FIG. 2 illustrates an enlarged schematic view of a single elevator car within the multicar elevator system of FIG. 1, in accordance with an embodiment of the disclosure.

Turning now to FIG. 2, a view of an elevator system 110 including an elevator car 114 that travels in lane 113 is shown. Elevator car 114 is guided by one or more guide rails 124 extending along the length of lane 113, where the guide rails 124 may be affixed to a structural member 119. For ease of illustration, the view of FIG. 2 only depicts a single guide rail 124; however, there may be any number of guide rails positioned within the lane 113 and may, for example, be positioned on opposite sides of the elevator car 114. Elevator system 110 employs a linear propulsion system as described above, where a first part 116 includes multiple motor segments 122*a*, 122*b*, 122*c*, 122*d* each with one or more coils 126 (i.e., phase windings). The first part 116 may be mounted to guide rail 124, incorporated into the guide rail 124, or may be located apart from guide rail 124 on structural member 119. The first part 116 serves as a stator of a permanent magnet synchronous linear motor to impart force to elevator car 114. The second part 118, as shown in FIG. 2, is mounted to the elevator car 114 and includes an array of one or more permanent magnets 128 to form a second portion of the linear propulsion system of the ropeless elevator system. Coils 126 of motor segments 122*a*, 122*b*, 122*c*, 122*d* may be arranged in one or more phases, as is known in the electric motor art, e.g., three, six, etc. One or more first parts 116 may be mounted in the lane 113, to co-act with permanent magnets 128 mounted to elevator car 114. Although only a single side of elevator car 114 is shown with permanent magnets 128 the example of FIG. 2, the permanent magnets 128 may be positioned on two or more sides of elevator car 114. Alternate embodiments may use a single first part 116/second part 118 configuration, or multiple first part 116/second part 118 configurations.

In the example of FIG. 2, there are four motor segments 122*a*, 122*b*, 122*c*, 122*d* depicted. Each of the motor segments 122*a*, 122*b*, 122*c*, 122*d* has a corresponding or associated drive 120*a*, 120*b*, 120*c*, 120*d*. A system controller 125 provides drive signals to the motor segments 122*a*, 122*b*, 122*c*, 122*d* via drives 120*a*, 120*b*, 120*c*, 120*d* to control motion of the elevator car 114. The system controller 125 may be implemented using a microprocessor executing a computer program stored on a storage medium to perform the operations described herein. Alternatively, the system controller 125 may be implemented in hardware (e.g., field programmable gate array (FPGA), application specific integrated circuits (ASIC),) or in a combination of hardware/software. The system controller 125 may include power circuitry (e.g., an inverter or drive) to power the first part 116. Although a single system controller 125 is depicted, it will be understood by those of ordinary skill in the art that a plurality of system controllers may be used. For example, a single system controller may be provided to control the operation of a group of motor segments over a relatively short distance, and in some embodiments a single system controller may be provided for each drive unit or group of drive units, with the system controllers in communication with each other. In an embodiment, the system controller 125 controls the simultaneous operation of multiple elevator cars 114.

In some embodiments, as shown in FIG. 2, the elevator car 114 includes an on-board controller 156 with one or more transceivers 138 and a processor, or CPU, 134. The on-board controller 156 and the system controller 125 collectively form a control system where computational processing may be shifted between the on-board controller 156 and the system controller 125.

The on-board controller 156 and the system controller 125 may each include at least one processor and at least one associated memory comprising computer-executable instructions that, when executed by the processor, cause the processor to perform various operations. The processor may be but is not limited to a single-processor or multi-processor system of any of a wide array of possible architectures, including FPGA, central processing unit (CPU), ASIC, digital signal processor (DSP) or graphics processing unit (GPU) hardware arranged homogenously or heterogeneously. The memory may be a storage device such as, for example, a random access memory (RAM), read only memory (ROM), or other electronic, optical, magnetic or any other computer readable medium.

In some embodiments, the processor 134 of on-board controller 156 is configured to monitor one or more sensors (ex: occupancy detection system 190 discussed further below) and to communicate with one or more system controllers 125 via the transceivers 138. In some embodiments, to ensure reliable communication, elevator car 114 may include at least two transceivers 138 configured for redundancy of communication. The transceivers 138 can be set to operate at different frequencies, or communication channels, to minimize interference and to provide full duplex communication between the elevator car 114 and the one or more system controllers 125. In the example of FIG. 2, the on-board controller 156 interfaces with a load sensor 152 to detect an elevator load on a brake 136. The brake 136 may engage with the structural member 119, a guide rail 124, or other structure in the lane 113. Although the example of FIG. 2 depicts only a single load sensor 152 and brake 136, elevator car 114 can include multiple load sensors 152 and brakes 136.

Figure 3:
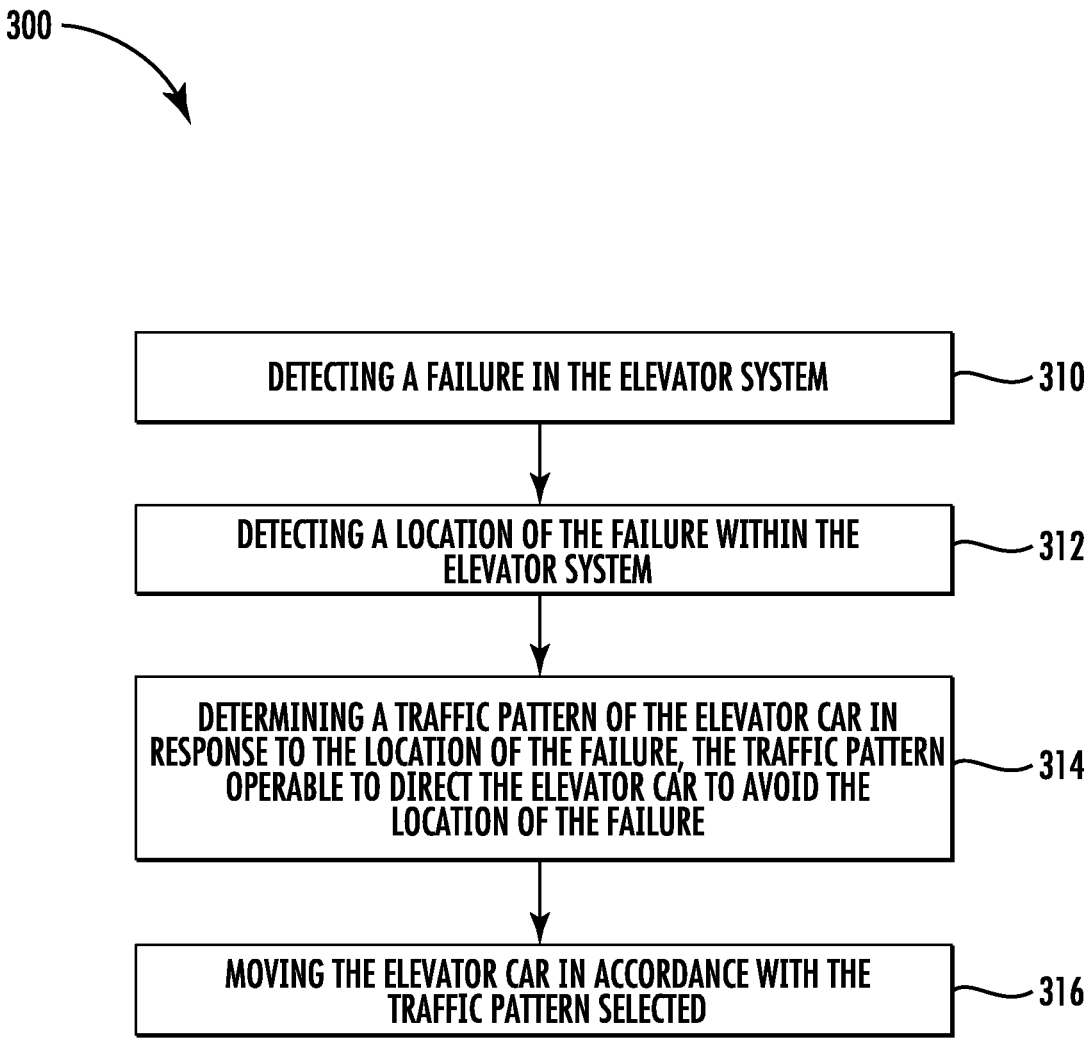
FIG. 3 is a flow diagram illustrating a method of operating the multi-car elevator system of FIGS. 1 and 2, according to an embodiment of the present disclosure.

Turning now to FIGS. 3-7 while continuing to reference FIGS. 1-2, FIG. 3 shows a flow diagram illustrating a method 300 of operating the elevator system 100 of FIGS. 1 and 2, according to an embodiment of the present disclosure. Method 300 is applicable to a first example illustrated by FIGS. 4-5 and a second example illustrated by 6-7, thus method 300 will be discussed first in reference to the example illustrated by FIGS. 4-5 and next in reference to FIGS. 6-7. In FIGS. 4-7, there are six lanes 113, 115, 117, 119, 121, 123 and twenty-six floors 140*a*-140*z*. These numbers of lanes and floors are for illustration, and thus embodiments disclosed herein may be applicable to buildings with various other number of lanes and floors.

Figure 5:
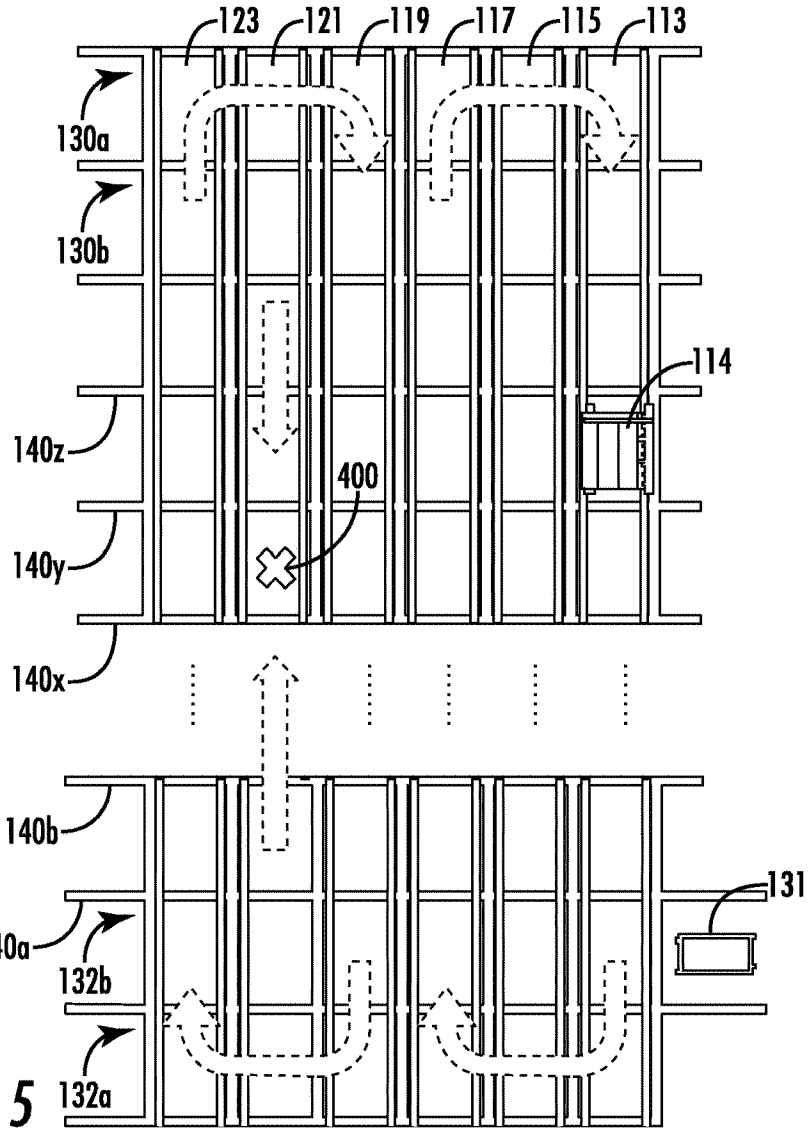
FIG. 5 illustrates a multicar elevator system operating after a failure, according to an embodiment of the present disclosure.
Figure 4:
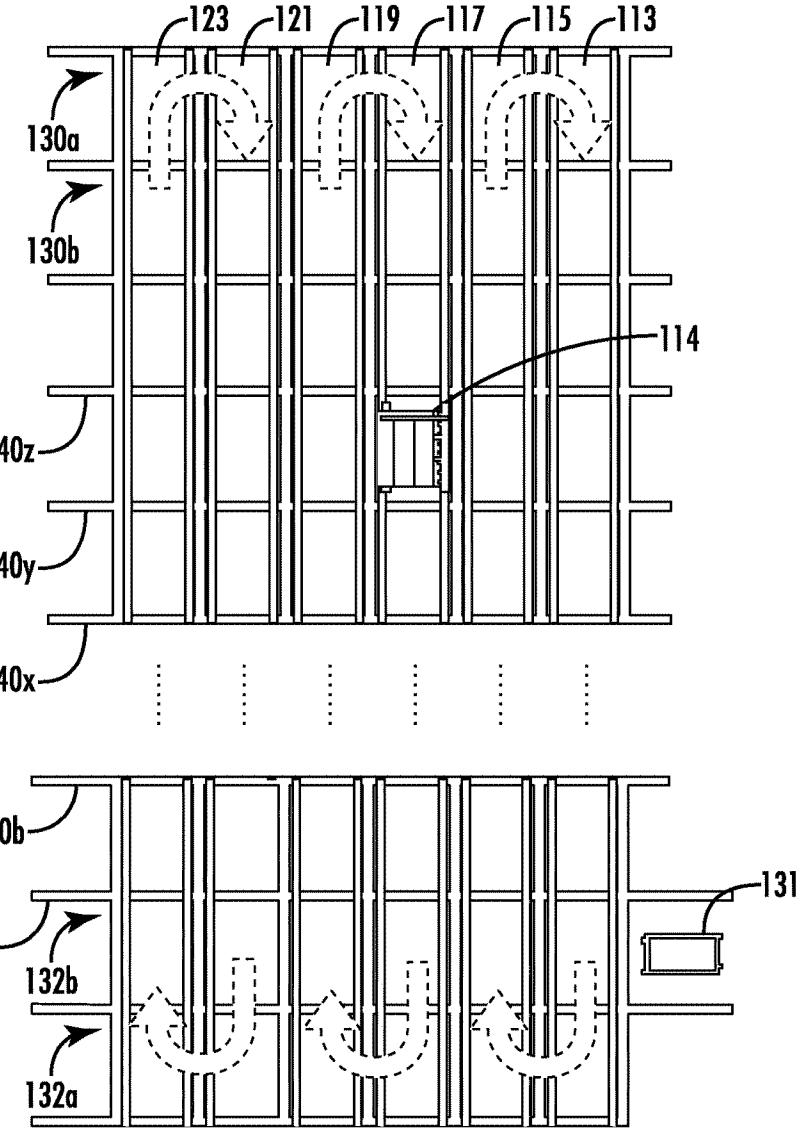
FIG. 4 illustrates a multicar elevator system operating prior to a failure, according to an embodiment of the present disclosure.

Referring now to FIGS. 4-5 in description of method 300 of FIG. 3. At block 310, a failure 400 in the elevator system 100 is detected. The failure may be a stopped elevator car 114, a stopped carriage 131, a failure in the motor segment 122, and/or any other failure in an elevator system 100 that may prevent movement of an elevator car 114. At block 312, a location of the failure 400 within the elevator system 100 is detected. In one example, the location of the failure 400 may be a regional location, such as, for example a lane or a transfer station. In another example, the failure location may be more specific and include the location within the lane and/or the transfer station. In FIG. 5 the failure 400 is located at floor 140*x* in lane 121. At block 314, with the location of the failure 400 now known, a traffic pattern of the elevator car 114 may be determined in response to the location of the failure 400. The traffic pattern may include: a preferred direction for each elevator car 114 in each lane that best accommodates the failure 400, and then a sequence of transitions to get to that preferred direction. The traffic pattern is operable to direct the elevator car 114 to avoid the location of the failure 400. Thus, the elevator car 114 may be directed to avoid floor 140*x* in lane 121. In order to avoid this location, elevators lanes 119, 121, 123 previously operating in a two lane loop, as seen in FIG. 4 may now need to operate in a three lane loop as seen in FIG. 5. The three lane loop allows elevator cars 114 to transfer from lane 123 directly to lane 119, thus skipping over lane 121 where the failure 400 is located. Elevator cars 114 already in lane 121 at the time of the failure 400 may need to reverse direction to exit lane 121. For instance an elevator car 114 on route to floor 140*z* may continue to floor 140*z* but then will have to change direction and head towards the upper transfer stations 130*a*, 130*b*. At block 316, the elevator car 114 is moved in accordance with the traffic pattern to avoid the failure 400 location. Elevator cars 114, traveling through lanes 117, 115, 113, may maintain a two lane loop, three land loop, or any other loop utilizing the open lanes. A variety of different loop options may be available to the remaining open lanes 123, 119, 117, 115, 113.

Figure 7:
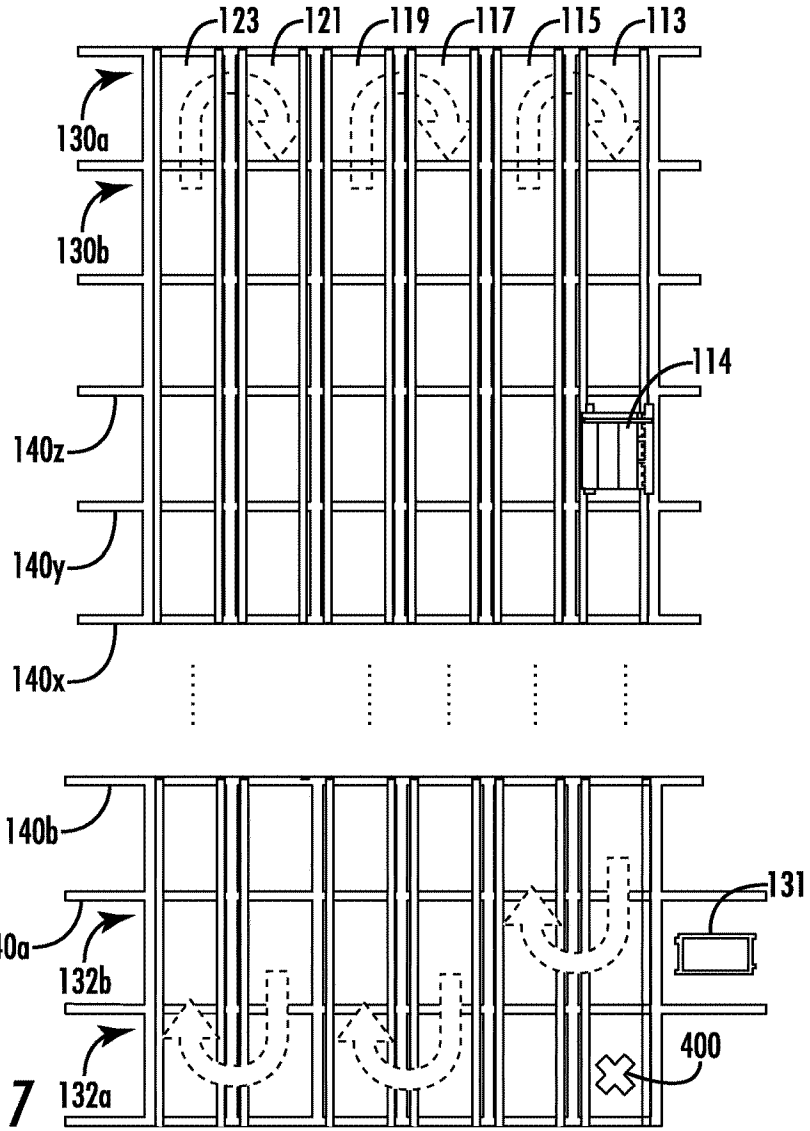
FIG. 7 illustrates a multicar elevator system operating after a failure, according to an embodiment of the present disclosure.
Figure 6:
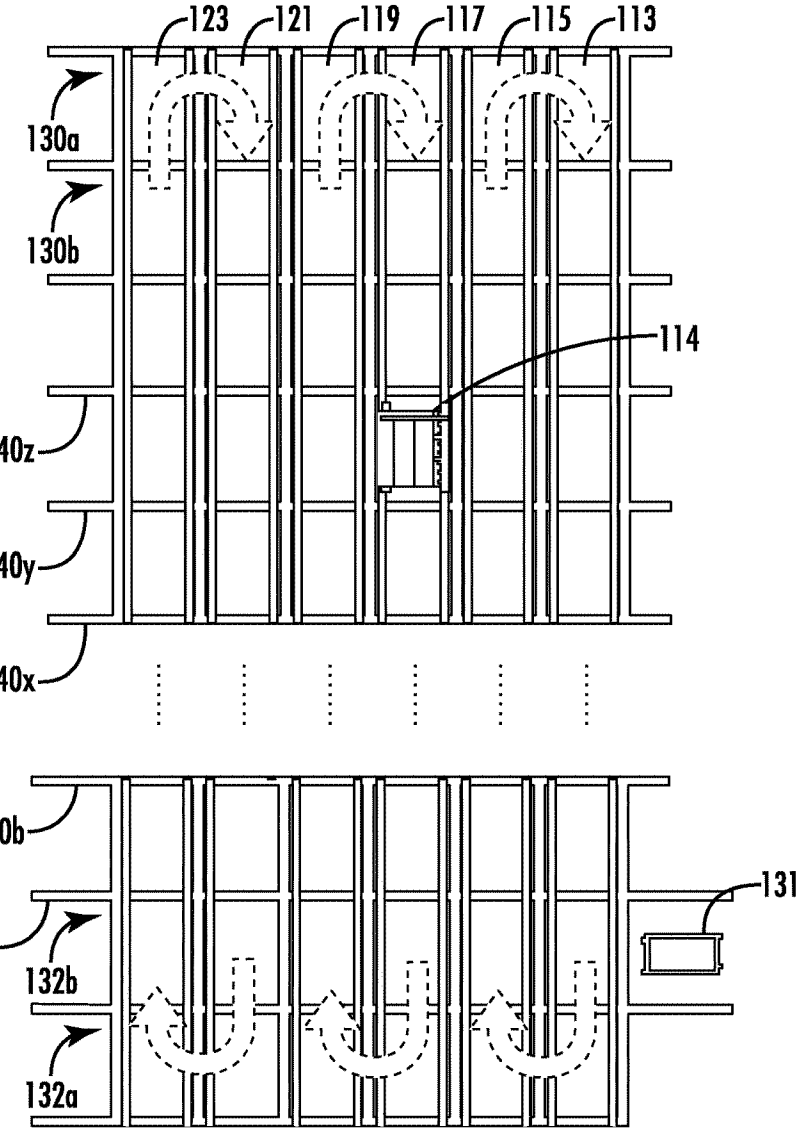
FIG. 6 illustrates a multicar elevator system operating prior to a failure, according to an embodiment of the present disclosure.

Referring now to FIGS. 6-7 in description of method 300 of FIG. 3. At block 310, a failure 400 in the elevator system 100 is detected. The failure may be a stopped elevator car 114, a stopped carriage 131, a failure in the motor segment 122, and/or any other failure in an elevator system 100 that may prevent movement of an elevator car 114. At block 312, a location of the failure 400 within the elevator system 100 is detected. In an example, the location of the failure 400 may be a regional location, such as, for example a lane or a transfer station. In another example, the failure location may be more specific and include the location within the lane and/or the transfer station. In FIG. 7 the failure 400 is located at the first lower transfer station 132*a* in lane 113. At block 314, with the location of the failure 400 now known, a traffic pattern of the elevator car 114 may be determined in response to the location of the failure 400. The traffic pattern is operable to direct the elevator car 114 to avoid the location of the failure 400. The traffic pattern may include: a preferred direction for each elevator car 114 in each lane that best accommodates the failure 400, and then a sequence of transitions to get to that preferred direction. The new traffic pattern may make use of a different transfer station. Thus, the elevator car 114 may be directed to avoid the first lower transfer station 132*a* in lane 113. In order to avoid this location, elevator cars 114 previously operating in a two lane loop through the first lower transfer station 132*a* from lane 113 to lane 115, as seen in FIG. 6 may now need to operate in a two lane loop through the second lower transfer station 132*b* from lane 113 to lane 115, as seen in FIG. 7. Utilizing the second lower transfer station 132*b* allows elevator cars 114 to transfer from lane 113 directly to lane 115, skipping the first lower transfer station 132*a* where the failure 400 is located. At block 316, the elevator car is moved in accordance with the traffic pattern to avoid the failure 400 location.

While the above description has described the flow process of FIG. 3 in a particular order, it should be appreciated that unless otherwise specifically required in the attached claims that the ordering of the steps may be varied.

Figure 8:
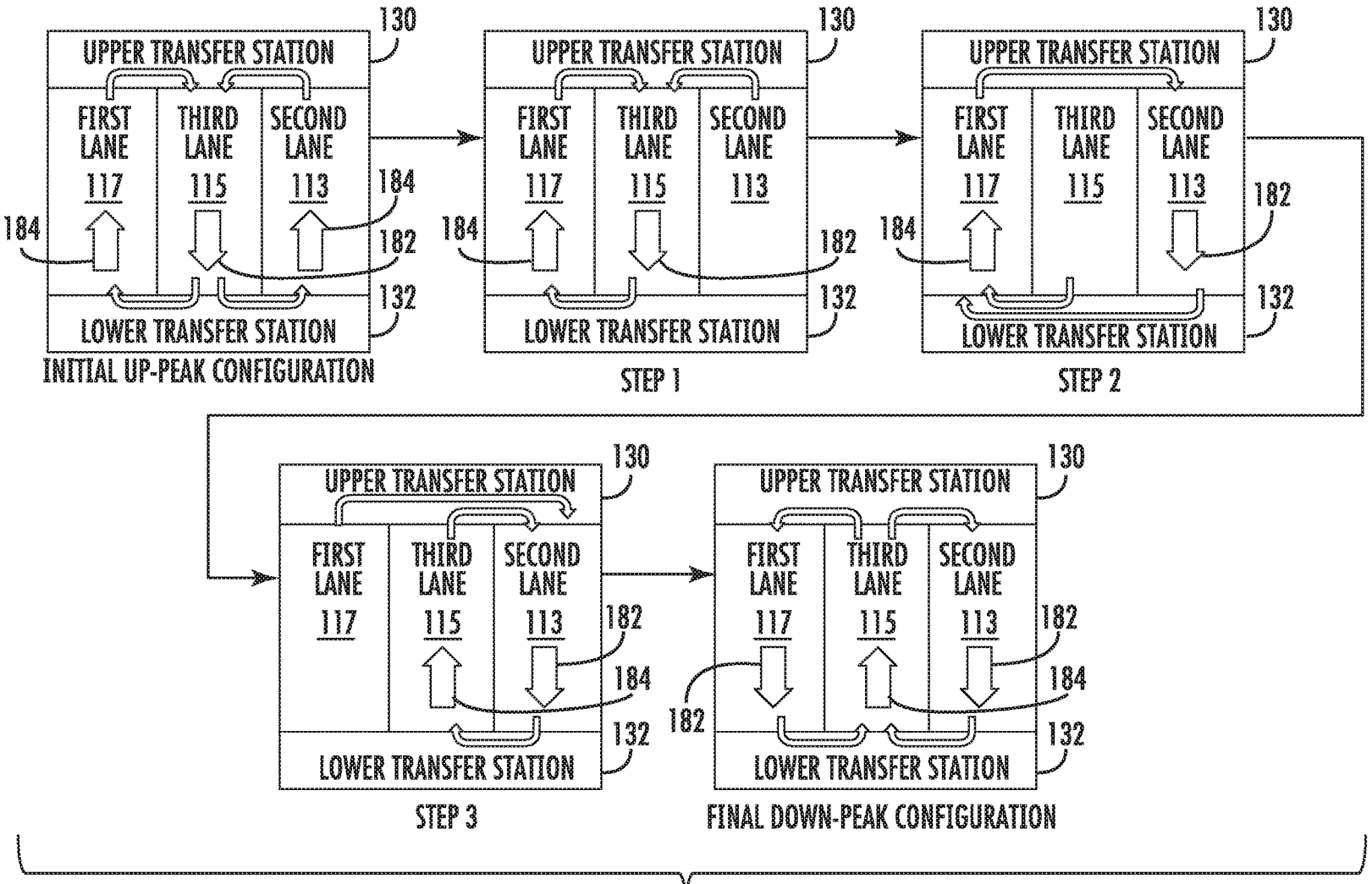
FIG. 8 is a flow diagram illustrating a method of switching the multi-car elevator system of FIGS. 1 and 2 from Up-Peak to Down-Peak operation, according to an embodiment of the present disclosure.
Figure 8:
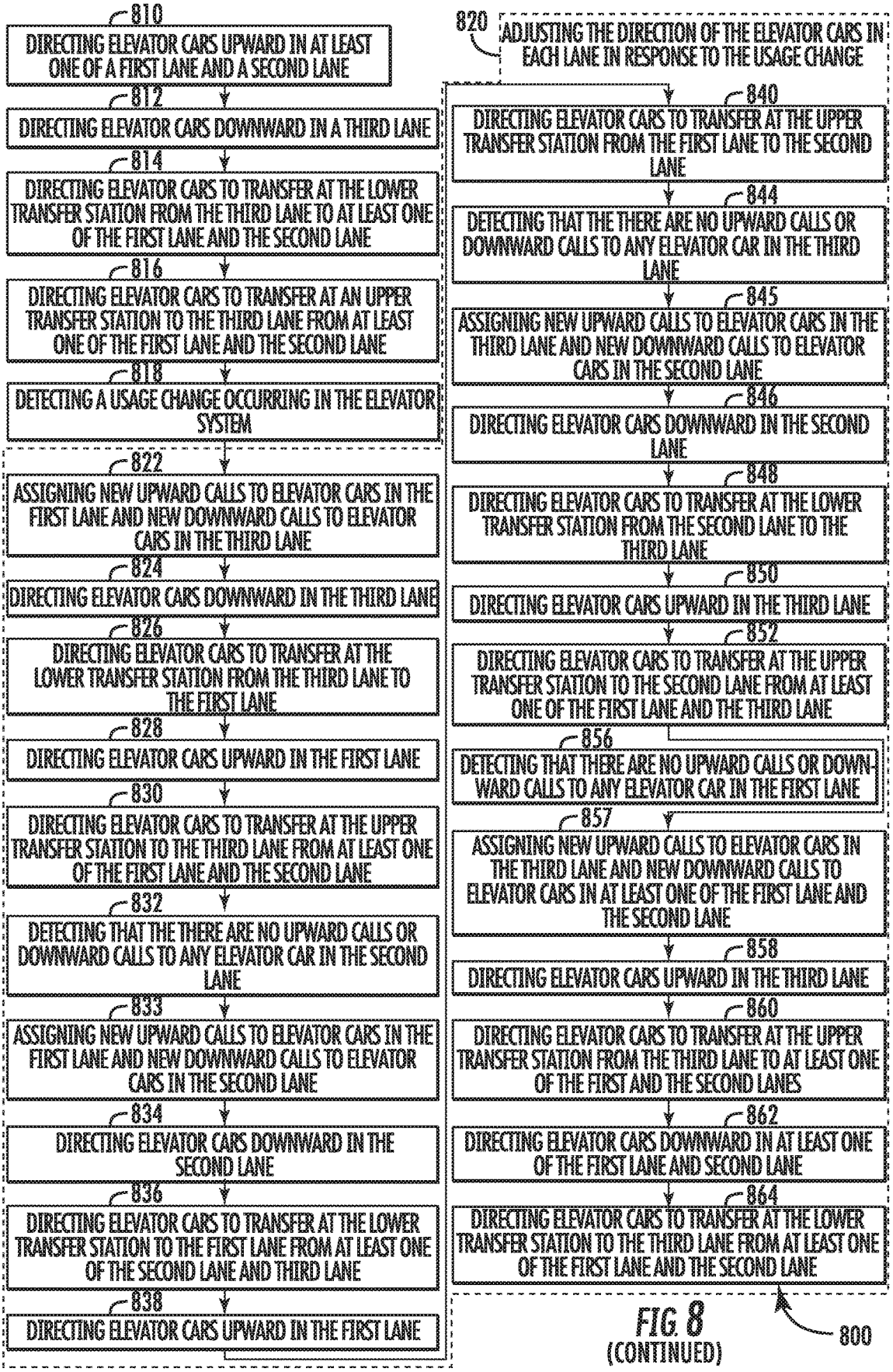

Turning now to FIG. 8 while continuing to reference FIGS. 1-2, FIG. 8 shows a flow diagram illustrating a method 800 of operating the elevator system 100 of FIGS. 1 and 2, according to an embodiment of the present disclosure. The method 800 begins at an up-peak configuration meaning that the priority of the elevator system 100 is to transfer passengers up or in a first direction 184. The up-peak configuration may occur in the morning, when most people are entering the building on the ground floor and need to be brought up to their work floor.

Blocks 810-816 describe the up-peak configuration. At block 810, elevator cars 114 are directed upward 184 in at least one of a first lane 117 and a second lane 113. At block 812, the elevator cars 114 are directed downward 182 in a third lane 115. In an embodiment, the third lane 115 may be located in between the first lane 117 and the second lane 113. At block 814, elevator cars 114 are directed to transfer at a lower transfer station 132 from the third lane 115 to at least one of the first lane 117 and the second lane. At block 816, elevator cars 114 are directed to transfer at an upper transfer station to the third lane 115 from at least one of the first lane 117 and the second lane 113.

At block 818, a usage change occurring in the elevator system 100 is detected. The usage change may mean that the elevator system 100 is switching from up-peak to down-peak and people may be starting to go home. The usage change may follow a manual order and/or a given schedule. Thus, more elevator cars 114 will be used to take people down than up. To switch from up-peak to down-peak, it takes about four steps, counting the final configuration, as seen in FIG. 8 at block 820. At block 820, the direction of the elevator cars 114 in each lane 117, 115, 113 is adjusted in response to the usage change.

The first step of the change over from up-peak to down-peak includes block 822-830. At block 822, new upward calls are assigned to elevator cars 114 in the first lane 114 and new downward calls are assigned to elevator cars 114 in the third lane 115. Thus, during the first step, there may be no new calls assigned to elevator cars 114 in the second lane 113. Existing calls requiring elevator cars 114 in the second lane 113 may be transferred to other lanes and/or an elevator car 114 may be transferred into the second lane 113 to cover an existing call until all existing elevator calls have been answered for the second lane 113. Upward calls are elevator calls requesting an elevator car 114 to more upward 184 to a particular floor and downward calls are elevator calls requesting an elevator car 114 to move downward 182 to a particular floor. At block 824, elevator cars 114 are directed downward 182 in the third lane 115. At block 826, elevator cars 114 are directed to transfer at the lower transfer station 132 from the third lane 115 to the first lane 117. At block 828, elevator cars 114 are directed upward 184 in the first lane 117. At block 830, elevator cars 114 are directed to transfer at the upper transfer station 130 to the third lane 115 from at least one of the first lane 117 and the second lane.

The second step of the change over from up-peak to down-peak includes blocks 832-840. At block 832, it is detected that there are no upward calls or downward calls to any elevator car in the second lane 113. At block 833, new upward calls are assigned to elevator cars 114 in the first lane 117 and new downward calls are assigned to elevator cars 114 in the second lane 113. Thus, during the second step, there may be no new calls assigned to elevator cars 114 in the third lane 115. Existing calls requiring elevator cars 114 in the third lane 115 may be transferred to other lanes and/or an elevator car 114 may be transferred into the third lane 115 to cover an existing call until all existing elevator calls have been answered for the third lane 115. At block 834, elevator cars 114 are directed downward 182 in the second lane 113. At block 836, elevator cars 114 are directed to transfer at the lower transfer station 132 from the second lane 113 to the first lane 117. At block 838, elevator cars 114 are directed upward 184 in the first lane 117. At block 840, elevator cars 114 are directed to transfer at the upper transfer station 130 from the first lane 117 to the second lane 113. At block 842, all elevator cars 114 are directed out of the third lane 115.

The third step of the change over from up-peak to down-peak includes block 844-852. At block 844, it is detected that there are no upward calls or downward calls to any elevator car 114 in the third lane 115. At block 445, new upward calls are assigned to elevator cars 114 in the third lane 115 and new downward calls are assigned to elevator cars 114 in the second lane 113. Thus, during the third step, there may be no new calls assigned to elevator cars 114 in the first lane 117. Existing calls requiring elevator cars 114 in the first lane 117 may be transferred to other lanes and/or an elevator car 114 may be transferred into the first lane 117 to cover an existing call until all existing elevator calls have been answered for the first lane 117. At block 846, elevator cars 114 are directed downward 182 in the second lane 113. At block 848, elevator cars 114 are directed to transfer at the lower transfer station 132 from the second lane 113 to the third lane 115. At block 850, elevator cars 114 are directed upward 184 in the third lane 115. At block 852, elevator cars 114 are directed to transfer at the upper transfer station 130 to the second lane 113 from at least one of the first lane 117 and the third lane 115.

The fourth step of the change over from up-peak to down-peak and thus the final down-peak configuration includes block 856-864. At block 856, it is detected that there are no upward calls or downward calls to any elevator car 114 in the first lane 117. At block 857, new upward calls are assigned to elevator cars 114 in the third lane 115 and new downward calls are assigned to elevator cars 114 in at least one of the first lane 117 and the second lane 113. At block 858, elevator cars 114 are directed upward 184 in the third lane 115. At block 860, elevator cars 114 are directed to transfer at the upper transfer station 130 from the third lane 115 to at least one of the first lane 117 and second lane 113. At block 862, elevator cars 114 are directed downward 182 in at least one of the first lane 117 and the second lane 113. At block 864, elevator cars 114 are directed to transfer at the lower transfer station 132 to the third lane 115 from at least one of the first lane 117 and the second lane 113.

While the above description has described the flow process of FIG. 8 in a particular order, it should be appreciated that unless otherwise specifically required in the attached claims that the ordering of the steps may be varied. For instance, the method 800 illustration in FIG. 8 may be reversed to transfer the elevator system 100 from down-peak to up-peak.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of operating an elevator system having at least one lane, the method comprising:

detecting a failure in the elevator system;

detecting a location of the failure within the elevator system, wherein the failure prevents movement of any elevator car of the elevator system at the location of the failure;

determining a traffic pattern of an elevator car in response to the location of the failure, the traffic pattern operable to direct the elevator car to avoid the location of the failure; and moving the elevator car in accordance with the traffic pattern selected, wherein a lane where the failure is located is still available for use by the elevator car excluding the location of the failure, wherein landings above the location of the failure are still accessible by the elevator car in the lane where the failure is located.

2. The method of claim 1, further comprising:

directing the elevator car to use a second transfer station when the failure has occurred in a first transfer station.

3. The method of claim 1, further comprising:

directing the elevator car to a second lane when the failure has occurred in a first lane.

4. The method of claim 1, further comprising:

directing the elevator car in a first lane to reverse direction of travel when the failure has occurred in the direction of travel in the first lane.

5. The method of claim 1, further comprising:

directing the elevator car to transfer from a first lane to a third lane, when the failure has occurred in a second lane.

* * * * *